United States Patent [19]

Ito et al.

[11] 4,286,032

[45] Aug. 25, 1981

[54] ELECTROPHOTOGRAPHIC PROCESS AND APPARATUS THEREFOR

[75] Inventors: Michio Ito, Kawasaki; Nobuo Kitajima, Toride; Masanao Kasai, Tokyo; Shunichi Ishihara, Kodaira, all of Japan

[73] Assignee: Canon Kabushiki Kaisha, Tokyo, Japan

[21] Appl. No.: 31,592

[22] Filed: Apr. 19, 1979

[30] Foreign Application Priority Data

Apr. 27, 1978 [JP] Japan ..... 53-50629
Jan. 31, 1979 [JP] Japan ..... 54-10178

[51] Int. Cl.[3] ..... G03G 16/00
[52] U.S. Cl. ..... 430/55; 430/100; 430/126
[58] Field of Search ..... 430/55, 126, 100

[56] References Cited

U.S. PATENT DOCUMENTS

| | | | |
|---|---|---|---|
| 3,615,395 | 10/1971 | Yamaji | 430/126 |
| 3,707,738 | 12/1972 | Cartwright | 430/126 |
| 3,873,310 | 3/1975 | Bean | 430/55 |
| 4,141,728 | 2/1979 | Hemphill | 430/126 |

*Primary Examiner*—Mary F. Downey
*Attorney, Agent, or Firm*—Fitzpatrick, Cella, Harper & Scinto

[57] ABSTRACT

This invention presents a process and an apparatus for repeatedly forming a high contrast image on a photosensitive member substantially comprising a conductive layer, a photoconductive layer and an insulating layer. According to this invention, during the processing steps of a latent image formed on the photosensitive member, an exposure step or means is provided for preventing the effect of a corona discharge of the same polarity as of the polarity of the photoconductive layer from affecting the succeeding latent image formation on the photosensitive member.

10 Claims, 16 Drawing Figures

ELECTROPHOTOGRAPHIC PROCESS AND APPARATUS THEREFOR

BACKGROUND OF THE INVENTION

1. Field of the Invention

The present invention relates to an electrophotographic process and apparatus therefor, and more particularly to an electrophotographic process for achieving repeated image formation by means of a photosensitive member essentially composed of a conductive layer, a photoconductive layer and an insulating layer and an apparatus adapted for executing such process.

2. Description of the Prior Art

For the purpose of obtaining an image of a high contrast there is already known and commercially employed an electrophotographic process using a photosensitive member essentially consisting of a conductive layer, a photoconductive layer and an insulating layer and comprising for example a primary charging step for subjecting the surface of said photosensitive member to a uniform charging of a predetermined polarity, an image exposure step for exposing said surface to a light image, a secondary charging step for applying, approximately simultaneously with said image exposure, a corona discharge containing a component of a polarity opposite to the polarity of the primary charging, namely a DC corona discharge of said opposite polarity, an asymmetric AC corona discharge or an AC corona discharge, and a whole surface exposure step for uniformly illuminating the surface of said photosensitive member to form an electrostatic latent image, followed by the development and transfer of thus formed latent image thereby obtaining a reproduced image of said light image.

Also, even if such high-contrast image cannot be obtained, the electrophotographic processes utilizing a photo-sensitive member essentially composed of a conductive layer, a photoconductive layer and an insulating layer are known to be suitable for repeated use of the photosensitive member as the surface thereof can be rendered physically and chemically durable.

Such photosensitive member has however been found to result in a significant loss in image contrast in the repeated image formation in case of a certain combination of the polarity of the developer, of the secondary charging and of the corona discharge for image transfer.

Such contrast loss has been a serious problem in certain processes as such combination is for example indispensable for achieving a reversal development or for removing the excessive liquid in a liquid development.

The above-mentioned drawback will be more specifically explained in an example of electrophotographic process involving a reversal development shown in the attached drawings.

In such process schematically shown in FIG. 1, a photosensitive member A essentially composed of a conductive layer a1, a photoconductive layer a2 and an insulating layer a3 is at first subjected to a primary charging for example with a positive corona discharge in case said photoconductive layer a2 is of an N-type such as a CdS-binder system (FIG. 1(*a*)), then subjected to the exposure of a light image (L and D respectively indicating light and dark areas) simultaneously with a secondary charging with an AC corona or a DC corona containing a component of a polarity opposite to that of said primary charging (FIG. 1(*b*)), and is subjected to a whole surface exposure to obtain an electrostatic latent image wherein the light area L and the dark area D are respectively charged negatively and positively (FIG. 1(*c*)). The latent image thus obtained is rendered visible by reversal development with a dry or liquid developer T containing positively charged toner particles (FIG. 1(*d*)), and the thus developed image is transferred onto a transfer sheet or paper P by superposing said transfer sheet P on the surface of the photosensitive member A and applying a negative corona discharge from the back side of said transfer sheet P (FIG. 1(*e*)). Successively the photosensitive member utilized for the image formation is prepared for the succeeding imaging cycle by a cleaning step for eliminating the developer remaining on the surface of said photosensitive member.

In such process the contrast of the electrostatic latent image gradually decreases in the repeated use of the photosensitive member, and this phenomenon is attributed by the present inventors to the following facts.

In the image transfer step of the above-explained process the negative charging, through the transfer sheet, of the surface of the photosensitive member containing an N-type photoconductive layer induces a positive charge at the interface between the conductive layer a1 and the photoconductive layer a2, thus creating an electric field across the photoconductive layer.

The electrons which are injected from the conductive layer and retained at the interface between the photoconductive layer and the insulating layer in case of normal positive charging of the surface of the photosensitive member are repelled from the photoconductive layer to the conductive layer by the above-mentioned electric field, thus leaving positive spatial charges or positive holes in the photoconductive layer.

Said positive holes become retained in the traps in a gradually increasing number with the lapse of time.

Particularly in case of a photoconductive layer containing an elevated number of barriers such as a layer composed of ZnO or CdS and a binder, the above-mentioned positive holes are captured in deep traps and do not easily recombine.

Such trapped positive holes trap, in the vicinity thereof, the electrons injected at the succeeding primary charging, and likewise hinders the movement of the injected electrons toward the interface between the photoconductive layer and the insulating layer.

For such reason the electron injection to the interface between the photoconductive layer and the insulating layer becomes deficient, resulting in a lowered contrast in the succeeding imaging cycles.

Besides such trapped positive holes, being dependent on the image exposure in the preceding image forming cycle, appear as a memorized image in the succeeding imaging cycle.

SUMMARY OF THE INVENTION

The object of the present invention is to provide an electrophotographic process capable of repeated image formation with a high contrast with a photosensitive member essentially consisting of a conductive layer, a photoconductive layer and an insulating layer, and an apparatus adapted for conducting such process.

Another object of the present invention is to provide an electrophotographic process capable of providing a reversal developed image of a satisfactory contrast and an apparatus adapted for conducting such process.

Still another object of the present invention is to provide an electrophotographic process allowing to obtain a transferred image of a satisfactory contrast and an apparatus adapted for conducting such process.

More specifically the present invention is to provide an electrophotographic process achieving image formation by repeated use of a photosensitive member essentially consisting of a conductive layer, a photoconductive layer and an insulating layer, said process being featured, in the image process steps to be applied to the photosensitive member after the latent image formation and at the corona discharge of a polarity same as that of the material constituting the photoconductive layer of said photosensitive member, by providing an exposure step preventing the effect of said corona discharge on the succeeding latent image forming cycle on said photosensitive member.

A preferred embodiment of the present invention comprises, in an electrophotographic process repeatedly utilizing a photosensitive member essentially consisting of a conductive layer, a photoconductive layer and an insulating layer for image formation, a step of generating an electric filed across said photoconductive layer for image processing and a step of eliminating the electric field generated in said electric field generating step.

Another preferred embodiment of the present invention comprises, in an electrophotographic process repeatedly utilizing a photosensitive member essentially consisting of a conductive layer, a photoconductive layer and an insulating layer, a step of forming an electrostatic latent image corresponding to a light information having a light and dark contrast, a developing step for developing said electrostatic latent image formed on said photosensitive member, an exposure step for providing a light hysteresis of a predetermined period to the surface of said photosensitive member holding thus developed image thereon, and a step of applying a corona discharge of a polarity same as that of the photoconductive layer to said photosensitive member during the light hysteresis caused by said exposure step.

Also the present invention is to provide an apparatus adapted for conducting an electrophotographic process repeatedly utilizing a photosensitive member essentially consisting of a conductive layer, a photoconductive layer and an insulating layer, said apparatus being featured by a photosensitive member supported so as to allow cyclic displacement, primary corona discharge means for applying a corona discharge of a predetermined polarity to said photosensitive member, exposure means for applying to said photosensitive member a light information corresponding to the image to be reproduced, secondary corona discharge means for applying, simultaneously with the exposure applied by said exposure means, a corona discharge containing a component of a polarity opposite to that of said primary corona discharge, whole surface exposure means for applying a uniform exposure to the surface of said photosensitive member, developing means for applying a developer charged in a polarity same as that of said primary corona discharge to the electrostatic latent image formed on the surface of said photosensitive member, image processing corona discharge means for applying a corona discharge containing a component of a polarity same as that of the photoconductive layer of said photosensitive member to the surface thereof after the latent image formation, and exposure means for applying an exposure to the surface of the photosensitive member thereby preventing the effect of the corona discharge of said image processing corona discharge means on the succeeding latent image formation on said surface.

DESCRIPTION OF THE PREFERRED EMBODIMENTS

Figure 1:
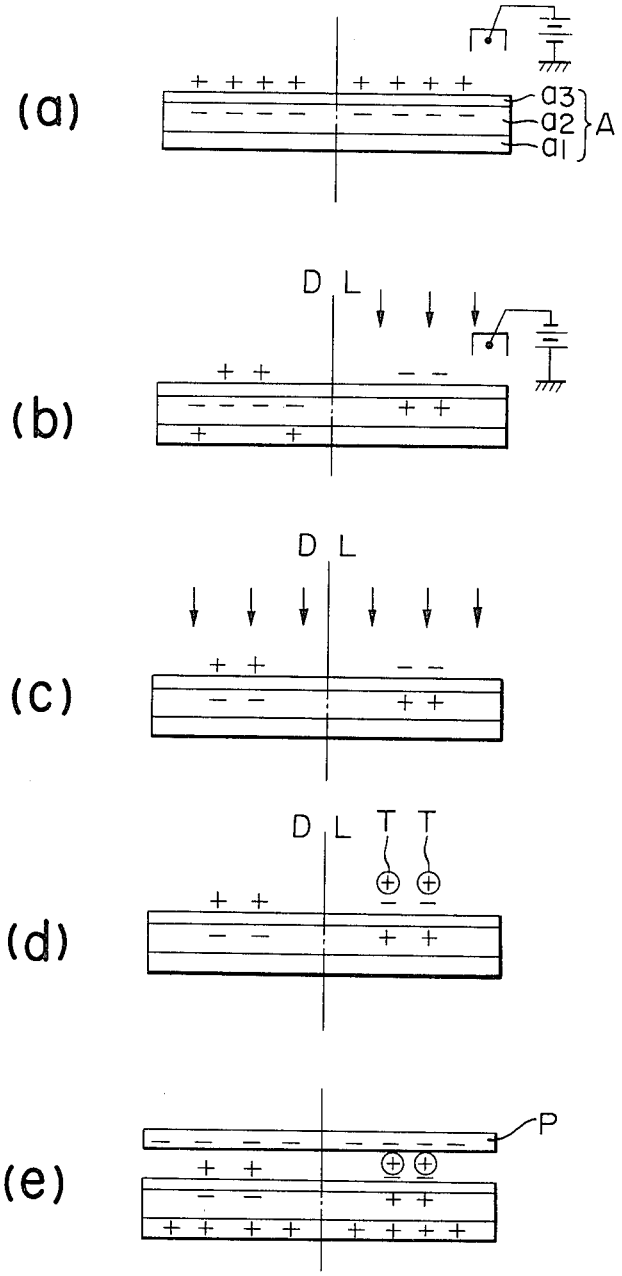
FIGS. 1(*a*)–1(*e*) are schematic views showing a conventional electrophotographic process, which should be improved by the present invention.
Figure 2:
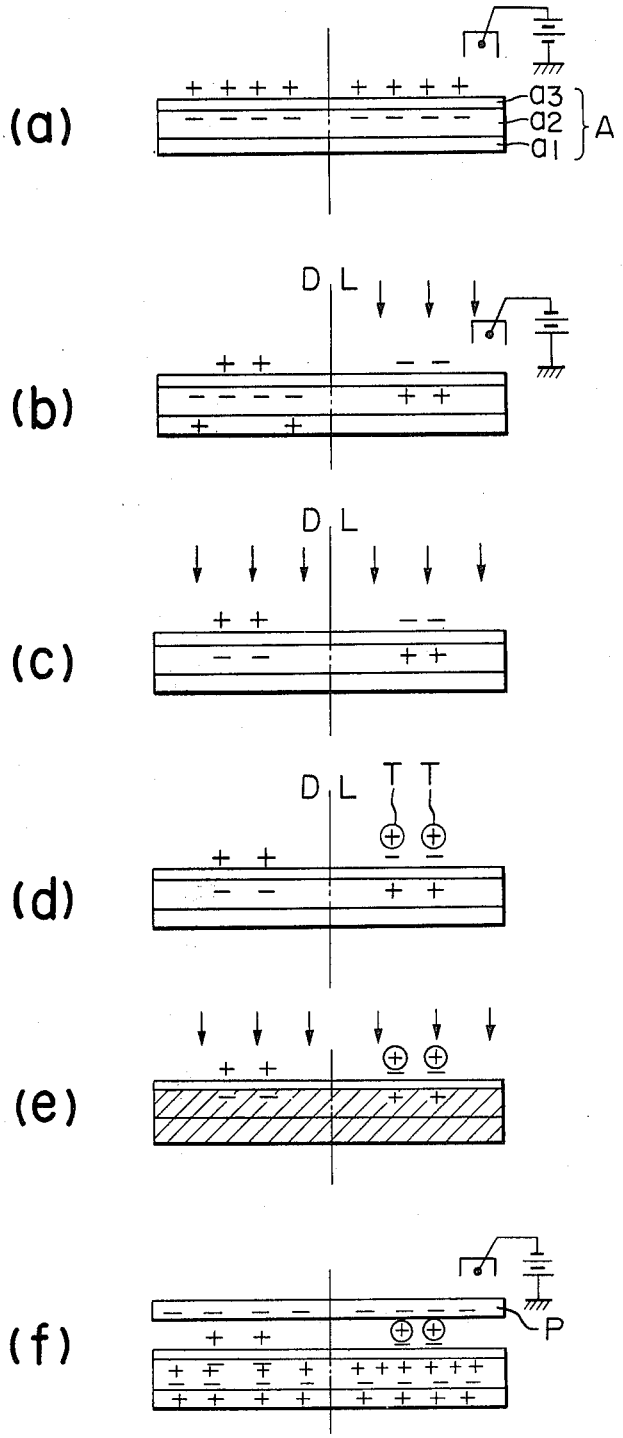
FIGS. 2(*a*)–2(*f*) are schematic views showing the electrophotographic process of the present invention.

The electrophotographic process according to the present invention is schematically shown in FIGS. 2(*a*)–2(*f*), wherein the components common with those shown in FIG. 1 are represented by the same symbols.

FIG. 2(*a*) shows a primary charging step for uniformly charging the surface of a photosensitive member A essentially composed of a conductive layer a1, a photoconductive layer a2 and an insulating layer a3 with a corona discharge or a determined polarity which is positive or negative respectively when said photoconductive layer is composed of an N-type material such as CdS or of a p-type material such as Se, the illustration being given for an N-type photoconductive layer.

FIG. 2(*b*) shows a step of exposing the surface of said photosensitive member thus uniformly charged to a light information having a distribution of light and dark areas for example obtained by scanning an original, and simultaneously applying a corona discharge having a component of a polarity opposite to that of said primary charging such as a DC corona discharge of such opposite polarity, an AC corona discharge or a combination thereof, the illustration being given for a negative DC discharge which is of an opposite polarity to that of the aforementioned primary charging.

FIG. 2(*c*) shows a whole surface exposure step for rapidly forming a surface potential distribution corresponding to the charge distribution formed by the above-mentioned light image exposure.

Thus an electrostatic latent image of a high contrast is formed on the surface of the photosensitive member.

FIG. 2(*d*) shows a developing step wherein said latent image is developed with a dry or liquid developer T containing toner particles charged in a polarity same as that of the dark area D for rendering the light area L visible thereby obtaining a so-called negative-positive reversal image. The foregoing steps are same as those explained in connection with FIGS. 1(*a*)–1(*d*).

FIG. 2(*e*) shows an exposure step for providing the photoconductive layer of the photosensitive member with a light hysteresis. By this exposure the photoconductive layer assumes a state of low resistance which is retained for a certain period as a light hysteresis.

FIG. 2(*f*) shows a transfer step conducted during the presence of the above-mentioned light hysteresis state, wherein a corona discharge of a polarity opposite to that of said toner particles (i.e. a negative corona discharge in the illustrated case) is applied to the back side of a transfer sheet thereby transferring the developed image onto said transfer sheet. The negative corona discharge thus applied induces a positive charge in the conductive layer of the photosensitive member. The thus induced positive charge, which would not be injected into the N-type photoconductive layer but form, in combination with the above-mentioned corona discharge, an electric field across the photoconductive layer if said N-type photoconductive layer is in a dark state, does not form such electric field when the photoconductive layer is in a low resistance state because of the light hysteresis, as the negative carriers present in a good number in the photoconductive layer are attracted by said positive charge and migrate through said layer to neutralize said positive charge induced at the interface of the conductive layer and the photoconductive layer. In this manner the negative charge applied by the transferring corona discharge induces a positive charge on the conductive layer side.

However, because of the light hysteresis in the photoconductive layer caused by said exposure, the spatial charges which would otherwise be captured in deep traps are released in this state, and electron-positive hole pairs are generated under the low resistance state of the photoconductive layer, so that the charge of the opposite polarity induced in the vicinity of the interface between the conductive layer and the photoconductive layer is immediately eliminated. In this manner it is rendered possible to eliminate the danger of formation of an electric field across the photoconductive layer.

The absence of such electric field eliminates the undesirable effect on the succeeding image formation. The photosensitive member, after completion of image transfer in such state, is subjected to a cleaning step and is thus prepared for the succeeding image formation.

Also according to the present invention the order of the above-mentioned steps shown in FIGS. 2(*e*) and 2(*f*) may be inverted. And the exposure step in this case is conducted succeeding to a step of applying a corona discharge of a polarity same as that of the photoconductive layer in the same manner as in the foregoing transfer step. In such inverted procedure an electric field is formed across the photoconductive layer by the negative charge applied by the transferring corona discharge, but such electric field is immediately cancelled by the succeeding exposure.

More specifically the negative charge applied on the surface of the insulating layer of the photosensitive member by the transfer corona discharge induces a positive charge on the conductive layer to form an electric field as explained in the foregoing. However the succeeding exposure releases the spatial charges from the deep traps in the photoconductive layer, and electron-positive hole pairs are formed in the low resistance state of said photoconductive layer, whereby the positive charge induced in the vicinity of the interface between the conductive layer and the photoconductive layer is cancelled to annulate the above-mentioned electric field.

Naturally the step of FIG. 2(*e*) can be conducted simultaneously with the step of FIG. 2(*f*), but the exposure cannot be conducted efficiently because of the presence of the transfer sheet and will require an extremely large amount of light in order to achieve a satisfactorily low resistance in the photoconductive layer.

This will be understood from the fact that the light transmission of ordinary business paper or letter paper is in a range of 15–30%. For example the light transmission is 24% in case of linen bond paper of 81 g/m$^2$, 23% in case of bank bond paper of 100 g/m$^2$, and 28% in case of high quality white bond paper of 64 g/m$^2$.

It is to be noted that the corona discharge leading to the contrast loss is not necessarily limited to the transfer corona discharge of a polarity same as that of the photoconductive layer.

For example in case of forming a latent image with a simultaneous process as shown for example, in U.S. Pat. No. 3,666,363 on a photosensitive member containing an N-type photoconductive layer, said latent image is composed of positively charged dark area D and non-charged or negatively charged light area L. After development with a liquid developer containing negatively charged toner particles, there is required a negative squeezing corona discharge, which however results in a formation of an electric field across the photoconductive layer. Therefore, also in case of such squeezing corona discharge, the above-mentioned post exposure can be advantageously employed prior to, simultaneously with or succeeding to said corona discharge.

Figure 3:
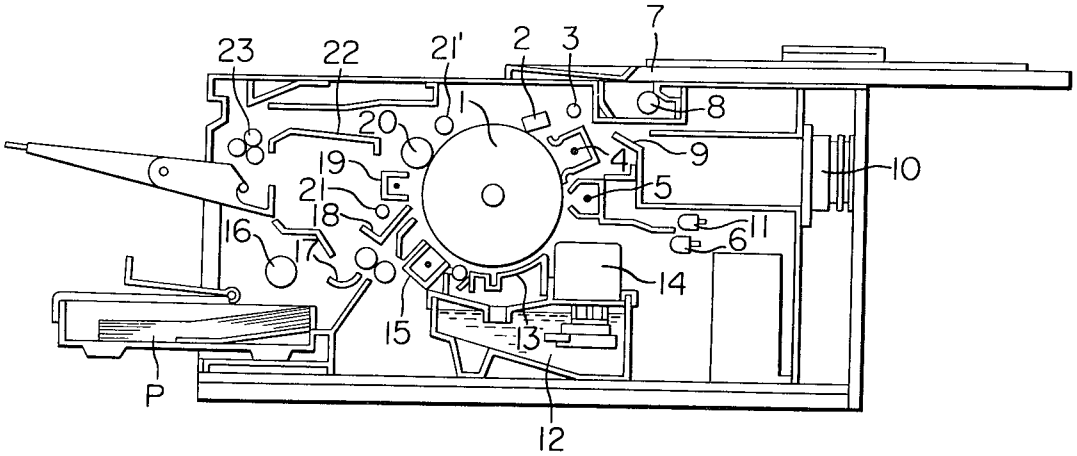
FIG. 3 is a schematic view of the electrophotographic apparatus embodying the present invention.

Now, reference is made to FIG. 3 showing, in a lateral view, an electrophotographic apparatus embodying the present invention.

A photosensitive drum 1 is composed of an aluminum foil serving as the conductive layer, which is coated, in a thickness of 50 microns, with a photoconductive layer composed of powdered CdS and a binder, and further covered with a Myler sheet of 35 micron thickness as the insulating layer, said drum being rotated clockwise.

Approximately on the top of said photosensitive drum 1 there are provided an elastic cleaning blade 2 consisting of rubber or synthetic resin and a pre-exposure lamp 3 for conditioning the surface of the photosensitive drum for image formation. Along the descending periphery of said photosensitive drum 1 there is provided latent image forming means comprising a primary corona discharger 4 for applying a positive charge onto the surface of said photosensitive drum, a secondary corona discharger 5 for applying a DC corona discharge of a polarity opposite to that of said primary corona discharge or an AC corona discharge, and a whole surface exposure lamp 6.

For the purpose of exposing the photosensitive drum to the light image there are provided an original support table 7, an original illuminating light source 8, a refrecting mirror 9 and an in-mirror lens 10, wherein said exposure being conducted through an optically open back of said secondary corona discharger. Naturally said light image exposure may also be conducted for example from a cathode ray tube or by means of a laser beam.

Under the photosensitive drum 1 there is provided a developing station 12 for developing the electrostatic latent image formed on said photosensitive drum. In the illustrated embodiment, the development is achieved with a liquid developer containing positively charged toner particles dispersed in a carrier liquid for performing a positive-negative reversal development; and 13 is a developing tray for bringing the liquid developer into contact with the surface of the photosensitive drum, and 14 is a supply pump for feeding the liquid developer to said developing tray. Succeeding to said developing station 12 there is provided a squeezing post-corona discharger 15 for removing the excessive liquid developer. Said squeezing effect can be obtained by a corona discharge of either polarity, but preferably by a positive corona discharge, namely of same polarity as that of the toner particles, since in this case it is possible to prevent the streaking of the developed image in addition to the above-mentioned squeezing effect.

Also there are provided a paper feed roller 16, a paper guide 17 and a timing roller 18 in order to guide a transfer sheet P to the transfer position.

Above the squeezing corona discharger there is provided a transfer corona discharger 19 for applying a negative corona discharge on the back side of said transfer sheet to attract the developed image thereonto.

Between said transfer corona discharger 19 and said post-corona discharger 15 there is provided a post-exposure source 21 composed for example of a tungsten lamp.

Upon exposure to said light source 21, the photosensitive drum holding the developed image thereon assumes a low resistance state as the light hysteresis, during the existence of which the photosensitive drum does not generate an electric field across the photoconductive layer even upon receipt of the above-mentioned transfer corona discharge. Said light source 21 may also be positioned above said transfer corona discharger 19 as indicated by 21'.

Along the upper periphery of the photosensitive drum there is provided separating means such as a separating roller 20 for separating the transfer sheet from the photosensitive drum.

Adjacent to said separating means there are positioned a hot-plate fixing station 22 for fixing the transferred image on said transferred sheet and a feed roller 23 for ejecting the transfer sheet after the fixing from the apparatus.

In an image forming apparatus with a negative-positive reversal development as explained in the foregoing, the negative charge applied on the photosensitive drum by said transfer corona discharge may lead to the formation of an undesirable electric field across the photoconductive layer, but the above-explained post exposure light source 21 eliminates the possibility of such electric field formation, thus avoiding the cause of the fatique of the photosensitive drum.

Such arrangement therefore prevents the loss of contrast even if continuous image formation and enables satisfactory image reproduction.

Furthermore, in case such adverse electric field across the photoconductive layer may result from any other cause then the above-mentioned transfer corona discharge, it is likewise effective to apply a post-exposure prior to, simultaneously with or succeeding to the step resulting in the formation of such electric field.

The present invention will be further clarified from the following example.

EXAMPLE

An aluminum drum with a polished surface was coated, in a thickness of 50 microns, with a photosensitive material composed of a mixture of 10 parts by weight of polyvinyl chloride with 100 parts by weight of cadmium sulfide activated with small amounts of copper and indium to form a photoconductive layer, which was further covered with a Mylar (trade name) sheet of about 35 microns thickness.

The photosensitive drum thus obtained was utilized for image formation in an apparatus shown in FIG. 3.

In the imaging process the primary corona discharger was supplied with a DC current of +6.5 kV while the secondary corona discharger was supplied with an AC current of 7.2 kV. Also the squeezing post-corona discharger was supplied with a DC current of +7.5 kV while the transfer corona discharger was supplied with a DC current of −5.0 kV. The photosensitive drum was utilized for repetitive image formation at a peripheral speed of 59 mm/sec, and the post-exposure for creating the light hysteresis was applied for 0.2 sec. at an intensity of 66 $\mu W/cm^2$ and 0.3 sec. prior to the application of the transfer corona discharge. Stated differently, the photosensitive member exposed to said transfer corona discharge was in a state of light hysteresis state of 0.3 sec. In such process the change in the dark potential was less than 0.2 even after 500 cycles of repeated image formation, and the image memory effect resulting from the adverse electric field caused by said transfer corona discharge could not be observed.

Figure 4:
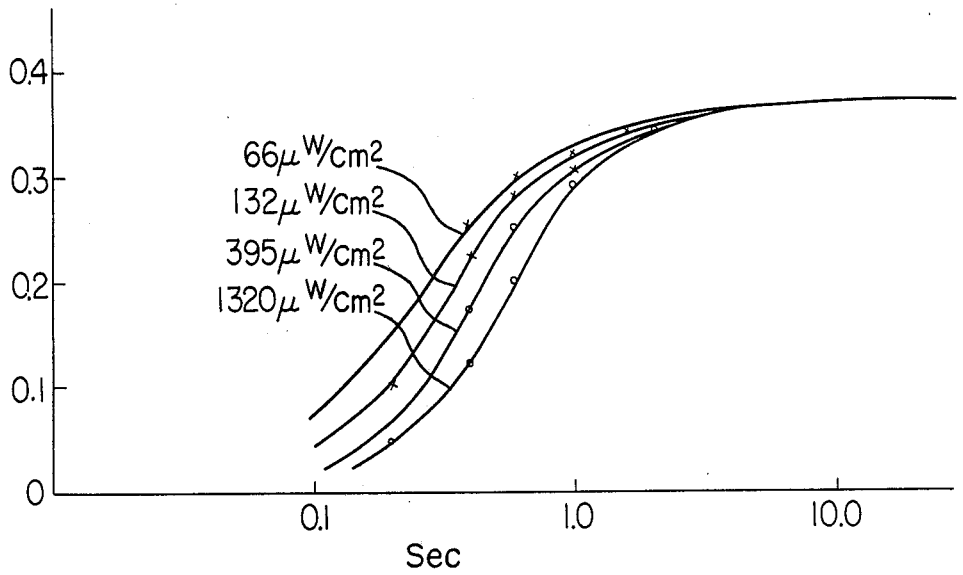
FIG. 4 is a chart showing the relationship between the period of light hysteresis and the dark potential in the repeated image formation in the apparatus embodying the present invention.

FIG. 4 shows the change in the dark potential in various light hysteresis states created by a post-exposure of 66, 132, 395 and 1320 $\mu W/cm^2$ for 0.2 seconds, wherein the abcissa representing the period of light hysteresis in seconds while the ordinate representing the dark potential change rate after 500 imaging cycles, i.e. the difference between the dark potential in the first cycle Vd 1 and the dark potential in the 500th cycle Vd 500 divided by Vd 1.

Figure 5:
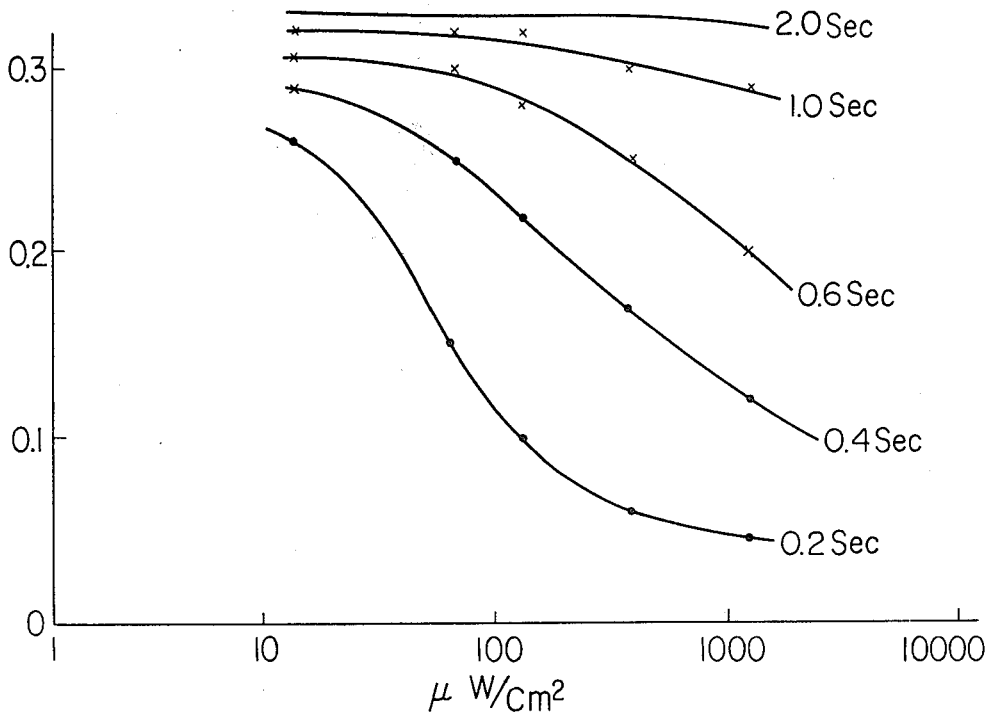
FIG. 5 is a chart showing the relationship between the intensity of exposure providing the light hysteresis and the dark potential decay.

Also FIG. 5 shows the relation between the dark potential change rate as defined above in the ordinate and the post-exposure intensity ($\mu W/cm^2$) in the abscissa at the light hysteresis time of 0.2, 0.4, 0.6, 1.0 or 1.2 sec. In all cases the post-exposure was conducted for 0.2 seconds. It will be seen from this chart that a satisfactory high contrast can be obtained even after repeated image formation if a predetermined light hysteresis is obtained with a sufficiently high light intensity.

According to the investigation of the present inventors it is confirmed that a satisfactory result cannot be obtained with the above-mentioned post-exposure if the electric field across the photoconductive layer has existed for a prolonged period. This is presumably due to the fact that the spatial charges present in the photoconductive layer are completely captured in the deep traps with the lapse of time.

Figure 6:
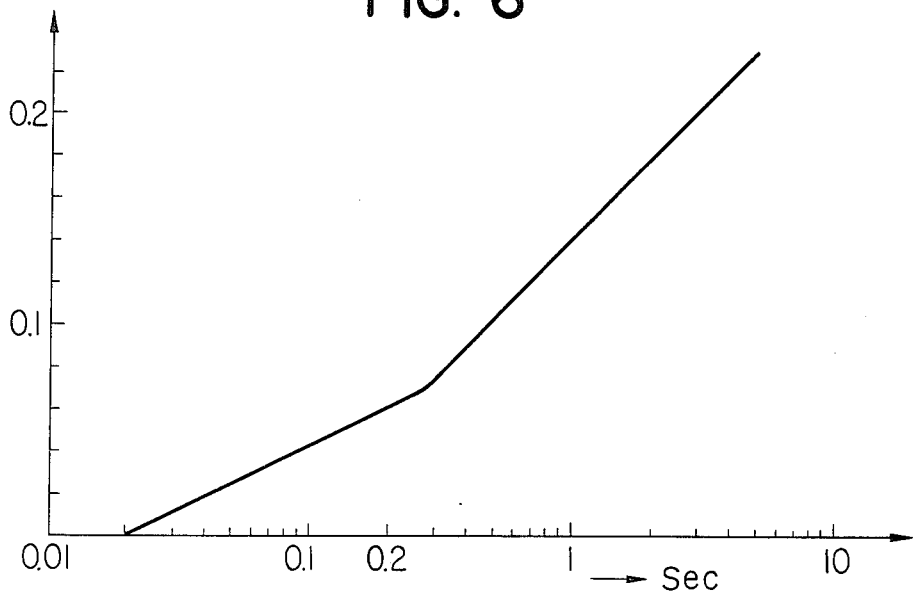
FIG. 6 is a chart showing the dark potential decay as a function of period of post-exposure for eliminating the electric field.

Thus FIG. 6 shows the change in the dark potential after 1000 cycles of electric field formation across the photoconductive layer followed by cancellation of said electric field with a post-exposure after different times, wherein the abscissa representing time in seconds while the ordinate representing the difference between the dark potential in the first cycle Vd 1 and that in the 1000th cycle Vd 1000 divided by Vd 1. The change in the time to the post-exposure was achieved by changing the position of said post-exposure in the apparatus shown in FIG. 3.

As can be seen from this chart, the loss of contrast becomes apparent if same time is equal to or longer than ca. 0.3 seconds.

Figure 7:
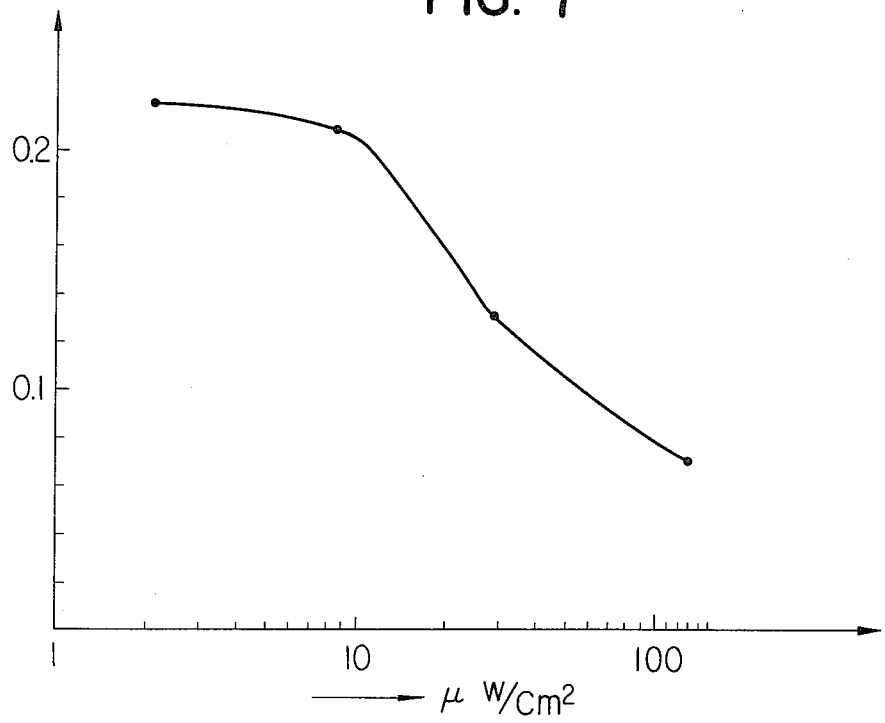
FIG. 7 is a chart showing the dark potential decay as a function of the amount of post-exposure for eliminating the electric field.

FIG. 7 shows the change in the dark potential after 20 cycles of electric field formation followed by post-exposure with a light of 800 nm of different intensities after 0.3 seconds, wherein the abscissa representing the amount of post-exposure in $\mu W/cm^2$ while the ordinate representing the different between the dark potential in the first cycle Vd 1 and that in the 20th cycle Vd 20 divided by Vd 1.

It will be observed that a satisfactory contrast could be maintained with an intensity of 8 $\mu W/cm^2$ or higher. It will therefore be understood that the number of incident photons becomes equal to or exceeds the number of trapped spatial charged respectively at said light intensity or at higher light intensity.

What we claim is:

1. An electrophotographic process using a photosensitive member for repeated image formations, wherein the photosensitive member essentially comprises a conductive layer, a photoconductive layer of a particular polarity type material, and an insulating layer, said process comprising the steps of:

forming an electrostatic latent image on the photosensitive member;

applying a developer to the latent-image-bearing photosensitive member;

subjecting the developer-bearing photosensitive member to an additional processing step including applying a corona discharge to the photosensitive member of a polarity which is the same as the polarity type of said photoconductive layer, and exposing the photosensitive member to light, thereby preventing the corona discharge from affecting the subsequent latent image formations on the photosensitive member.

2. An electrophotographic process using a photosensitive member for repeated image formations, wherein the photosensitive member essentially comprises a conductive layer, a photoconductive layer of a particular polarity type material, and an insulating layer, said process comprising the steps of:

forming an electrostatic latent image on the photosensitive member;

applying a developer to the latent-image-bearing photosensitive member;

subjecting the developer-bearing photosensitive member to an additional processing step including applying a corona discharge of a polarity the same as the polarity type of the photoconductive layer to the photosensitive member, while said photoconductive layer is in a state wherein it retains an electric field thereacross, and exposing the photosensitive member to light to eliminate said electric field across the photoconductive layer.

3. An electrophotographic process according to claim 2, in which the step of corona discharging comprises a negative charging of the surface of the photosensitive member having the photoconductive layer of N-type or a positive charging of the surface of the photosensitive member having the photoconductive layer of P-type.

4. An electrophotographic process according to claim 2, in which said corona charging step is a post charging step for uniformly charging the surface of the photosensitive member after the latent image has been developed.

5. An electrophotographic process according to claim 2, in which said corona discharging step is corona transfer step for transferring a developed latent image.

6. An electrophotographic process using a photosensitive member for repeated image formations, wherein the photosensitive member essentially comprises a conductive layer, a photoconductive layer of a particular polarity type material, and an insulating layer said process comprising the steps of:

forming an electrostatic latent image on the photosensitive member;

applying a developer to the latent-image-bearing photosensitive member;

subjecting the developer-bearing photosensitive member to an additional processing step including exposing the photosensitive member to light to provide said member with light hysteresis, and applying a corona discharge to the photosensitive member while said light hysteresis remains, wherein the corona discharge has a polarity which is the same as the polarity type of the photosensitive layer.

7. An electrophotographic process according to claim 6, in which the step for forming an electrostatic latent image on the photosensitive member comprises a primary corona discharging step, a light image exposure step, a secondary corona discharging step applied substantially simultaneously with the light image exposure, the secondary corona discharge having a component of a polarity opposite to the polarity of the primary discharging, and a whole surface exposure step.

8. An electrophotographic process according to claim 6, in which the step for developing an electrostatic latent image formed on the photosensitive member is to adhere a developing agent to the light area of the light image by selecting the polarity of the developing agent.

9. An electrophotographic process according to claim 6, in which the step for applying the corona discharge to the photosensitive member is a corona transfer step for transferring the developed latent image.

10. In an electrophotographic process for a repeated image formation using a photosensitive member essentially comprising a conductive layer, a photoconductive layer an insulating layer, an improvement is characterized by a primary charging step to uniformly apply a charge of a predetermined polarity to the photosensitive member, an exposure step of a light image corresponding to the image to be reproduced, a secondary charging step for applying a corona discharge to the photosensitive member substantially simultaneously with the light image exposure, the corona discharge having a component of a polarity opposite to the polarity of the primary charge, a whole surface exposure step to expose the whole surface of the photosensitive member, a developing step to develop the image with a developing agent of the same polarity as of the polarity of the primary charge, a transfer step to apply a corona discharge from the back of a transfer material of a polarity opposite to the polarity of the particles of a developing agent, a light exposure step to uniformly expose the photosensitive member and a cleaning step to clean the surface of the photosensitive member.

* * * * *